US007249472B2

(12) United States Patent
Fleissner

(10) Patent No.: US 7,249,472 B2
(45) Date of Patent: Jul. 31, 2007

(54) DEVICE FOR TREATING TEXTILE OR SIMILAR IN A CONTINUOUS STREAM

(75) Inventor: Gerold Fleissner, Zug (CH)

(73) Assignee: Fleissner GmbH & Co. Maschinenfabrik, Egelsbach (DE)

( * ) Notice: Subject to any disclaimer, the term of this patent is extended or adjusted under 35 U.S.C. 154(b) by 565 days.

(21) Appl. No.: 10/333,012

(22) PCT Filed: Jul. 12, 2001

(86) PCT No.: PCT/EP01/08035

§ 371 (c)(1),
(2), (4) Date: Jan. 15, 2003

(87) PCT Pub. No.: WO02/06577

PCT Pub. Date: Jan. 24, 2002

(65) Prior Publication Data

US 2003/0150244 A1 Aug. 14, 2003

(30) Foreign Application Priority Data

Jul. 18, 2000 (DE) ..... 100 35 299

(51) Int. Cl.
*D06B 3/10* (2006.01)

(52) U.S. Cl. ..... 68/5 C; 68/5 D; 68/19; 68/20

(58) Field of Classification Search ..... 68/202, 68/5 R, 8, 5 C, 5 D, 19, 20
See application file for complete search history.

(56) References Cited

U.S. PATENT DOCUMENTS 1,453,311 A * 5/1923 Engel, Sr. ..... 210/394
1,895,276 A * 1/1933 Cole ..... 210/771
2,454,134 A * 11/1948 Burleson ..... 210/404
2,525,181 A * 10/1950 Ransdell ..... 433/30
2,582,273 A * 1/1952 Peterson et al. ..... 210/404
2,632,189 A * 3/1953 La Chapelle ..... 12/145
2,669,910 A * 2/1954 Trotman ..... 162/357
3,200,951 A * 8/1965 Krynski ..... 210/404
3,409,139 A * 11/1968 Ferdinand et al. ..... 210/404
3,493,112 A * 2/1970 Bradley ..... 210/107

(Continued)

FOREIGN PATENT DOCUMENTS

JP 2-74661 * 3/1990

(Continued)

*Primary Examiner*—Frankie L. Stinson
(74) *Attorney, Agent, or Firm*—Antonelli, Terry, Stout & Kraus, LLP.

(57) ABSTRACT

The invention relates to a device for treating web-type textiles, nonwovens or paper in a continuous stream, uses a gaseous treatment agent that circulates in the device. The product lies on the exterior face of a permeable drum (5), which is subjected to an induced draught and has two base sections (11, 12) on its front face, more precisely on a sieve-type or perforated surface (9), which covers the drum structure. A perforated drum jacket (15), whose edges are merely clipped into the two base sections (11, 12) extends between said base sections (11, 12). To achieve this, an annular groove (17) is machined into the base sections (11, 12). The edge of the sheet metal (15) and a ring-shaped clip segment (23) are inserted into said groove and are retained there by means of screws.

12 Claims, 3 Drawing Sheets

Figure 1:
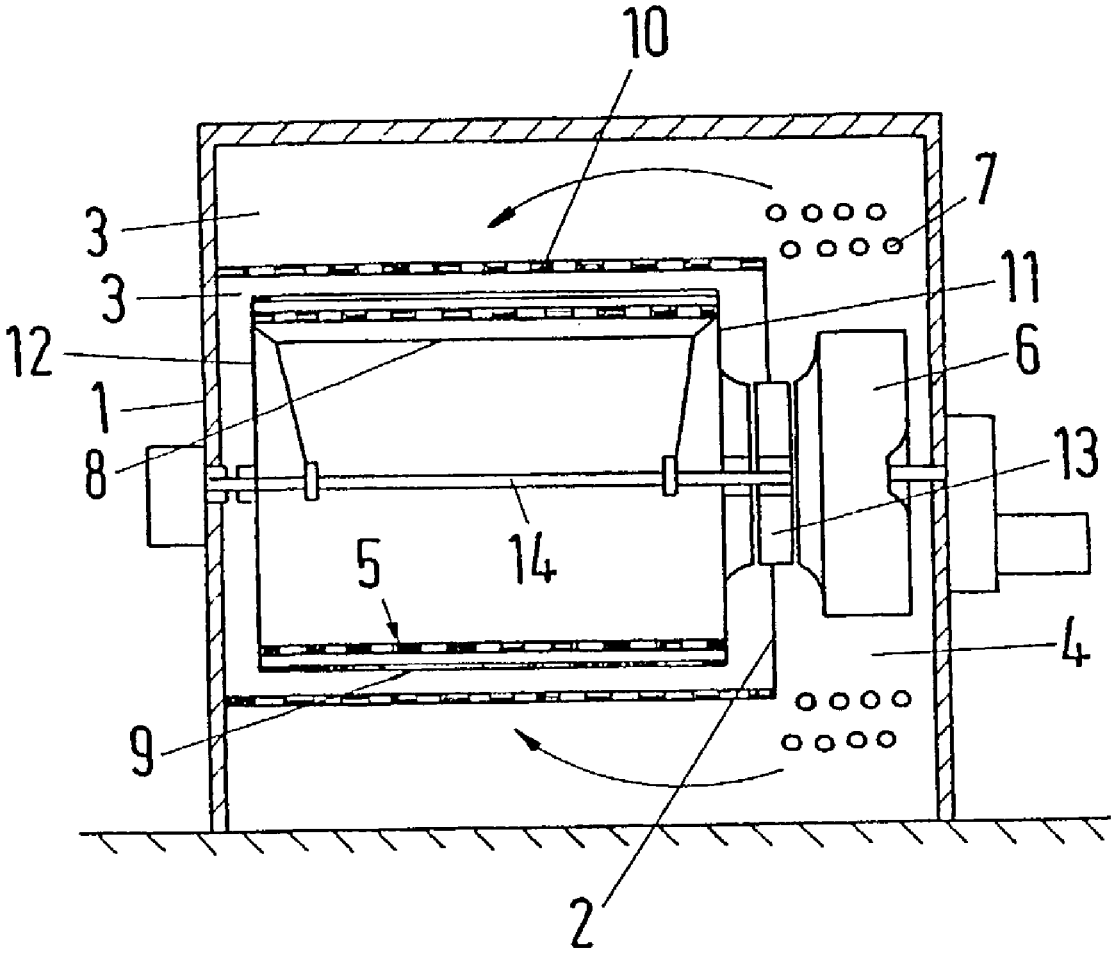

U.S. PATENT DOCUMENTS 3,814,259 A * 6/1974 Kamimura et al. ..... 210/391
3,880,711 A * 4/1975 Hayes, Jr. ..... 162/357
3,893,246 A * 7/1975 Fleissner ..... 34/115
3,919,088 A * 11/1975 Doncer et al. ..... 210/402
4,045,853 A * 9/1977 White ..... 29/896.62
4,057,437 A * 11/1977 Kracklauer ..... 127/9
4,255,261 A * 3/1981 Dodd ..... 210/193
4,401,564 A * 8/1983 Epper et al. ..... 210/150
4,481,021 A * 11/1984 Kinney et al. ..... 55/290
4,702,845 A * 10/1987 Wykoff ..... 210/784
4,936,934 A * 6/1990 Buehning ..... 156/167
5,326,471 A * 7/1994 Pietzsch ..... 210/402
5,792,349 A * 8/1998 Buettner et al. ..... 210/232
6,032,383 A * 3/2000 Fleissner ..... 34/115
6,088,927 A * 7/2000 Fleissner ..... 34/122
6,258,267 B1 * 7/2001 Ota ..... 210/238

FOREIGN PATENT DOCUMENTS

JP 3-258315 * 11/1991

* cited by examiner

DEVICE FOR TREATING TEXTILE OR SIMILAR IN A CONTINUOUS STREAM

The invention relates to an apparatus for treating, where applicable, strip-form textile material, non-woven fabric, woven fabric or paper in a continuous stream using a gaseous agent, which is circulated in the apparatus, having a permeable drum (5) as the conveying member, which drum has base portions (11, 12) on its end face and is subject to an induced draught, wherein the metal drum-jacket, which is securedly connected to the base portions (11, 12), extends between the base portions (11, 12) of the drum (5).

An apparatus of this type is known previously from many sieve drum designs such as, for example, the one according to DE-A-198 19 340. The sieve drum jacket has to be securedly connected to the end face base portions. This can be effected through an annular-shaped welded joint, which has the advantage that it ensures that the jacket is connected securedly to the base portions all round, but a welded joint is very susceptible to the temperature fluctuations which occur in practice. It is normal to screw the drum jacket onto the base portions using countersunk screws. This connection is adequately sturdy for normal drum circumferential speeds, but is unsatisfactory when greater demands are made. At high circumferential speeds the metal plates buckle between the screws such that in the long run the result is inexact rotational accuracy.

It is the object of the invention to find a design which enables the metal drum-jacket to be better secured to the base portions such that the centrifugal force can no longer affect this connection.

Proceeding from the basic design of a sieve drum of the aforementioned type, the invention consists in that the metal drum-jacket is connected substantially over its entire circumference to the associated base portion in a uniformly secured but detachable manner, by a circular clamping connection being provided for the securement of the metal drum-jacket to the associated base portion. A clamping connection at the end face of the drum for the securement of sheet-metal strips to the base portions of the drum, which metal strips extend in a radial manner, is known in DE-A-198 06 614, but in this case two radially aligned sheet-metal strips, which are flexible in the direction of the circumference, are respectively clamped in a radially aligned groove in the base portion of the drum. Contrary to this, according to the invention, preferably on the side facing the centre of the drum, an annular groove is formed in the base portion at the radial location of the metal drum-jacket which is to be secured there, in which annular groove the metal drum-jacket is securedly clamped around the drum.

The clamping of the metal drum-jacket in the annular groove is effected in an expedient manner such that the ring-shaped clamping groove has a clamping jaw, which is aligned axially in the direction of the metal drum-jacket so that the edge strip is retained in a non-curved manner in the clamping groove. The associated clamping jaw must then be configured so as to be conical. The metal drum-jacket consequently abuts the axially aligned clamping jaw and the remaining region is filled up by a clamping member, which is pulled by screws into the groove from the back of the base portion. The clamping member consists probably of individual segments which are closely adjacent one another and are cut from a complete ring.

This clamping locking arrangement of the metal drum-jacket to the two base portions can be applied to all designs of sieve drum machines. It is particularly advantageous on high-speed drums, for example, for the heat treatment of paper and woven fabric. These require a high degree of air permeability, which is achieved with the design according to DE-A-38 21 330. The production of these drum-jacket surfaces, however, is very involved and consequently expensive. The design according to DE-A-195 25 459 is simpler and in many cases adequate. For this jacket design, with U-shaped spacers on a normally perforated metal jacket, it is advantageous if the ring-shaped clamping groove is defined in the respective base portion by a radially inner side wail and an outer wail and these U-shaped profiles are mounted on the metal drum-jacket at a spacing from one another at the radial location of the outer side wail, the webs of which profiles are covered finally by a sieve-shaped covering radially outwardly for the receiving of the strip-form goods.

Figure 2:
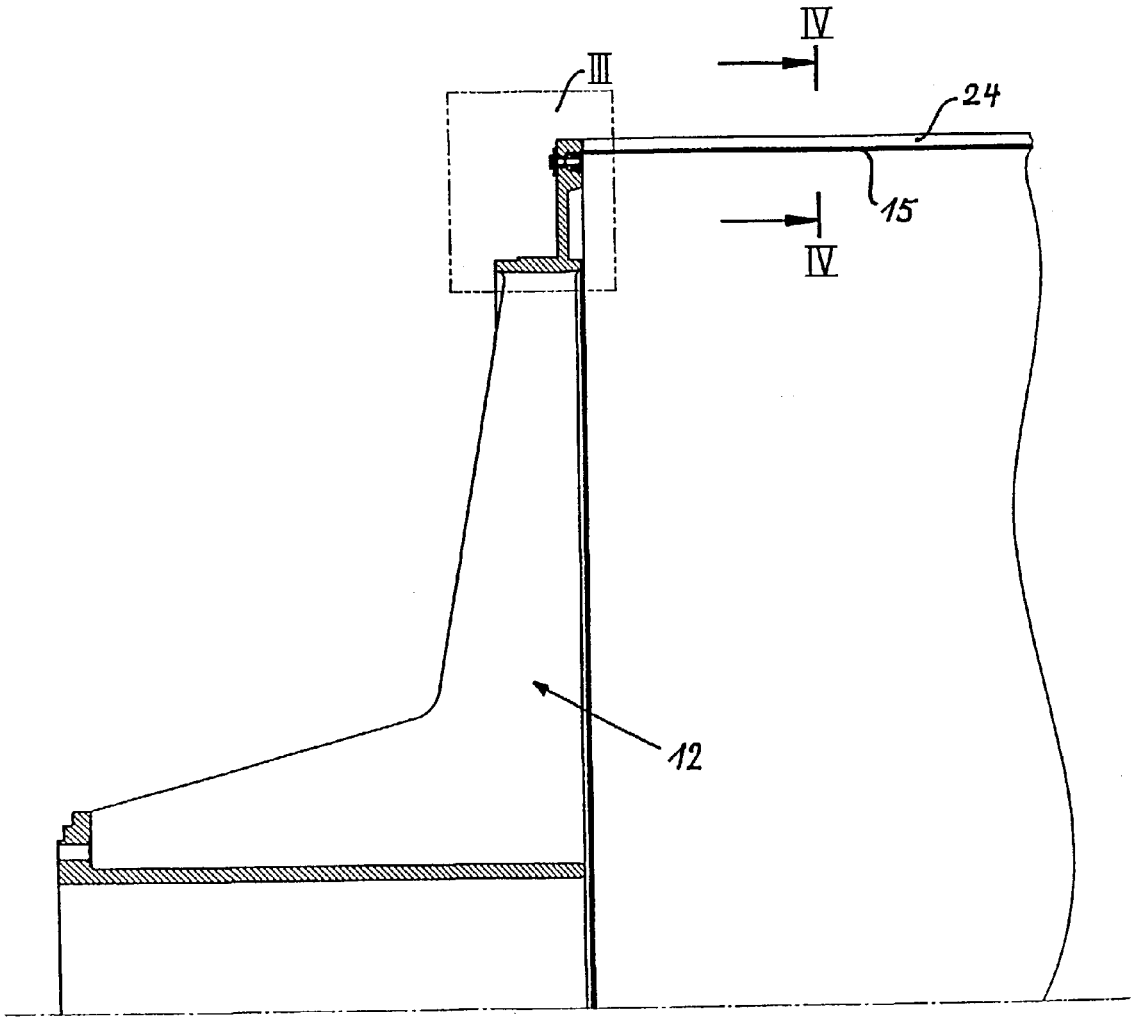
Figure 3:
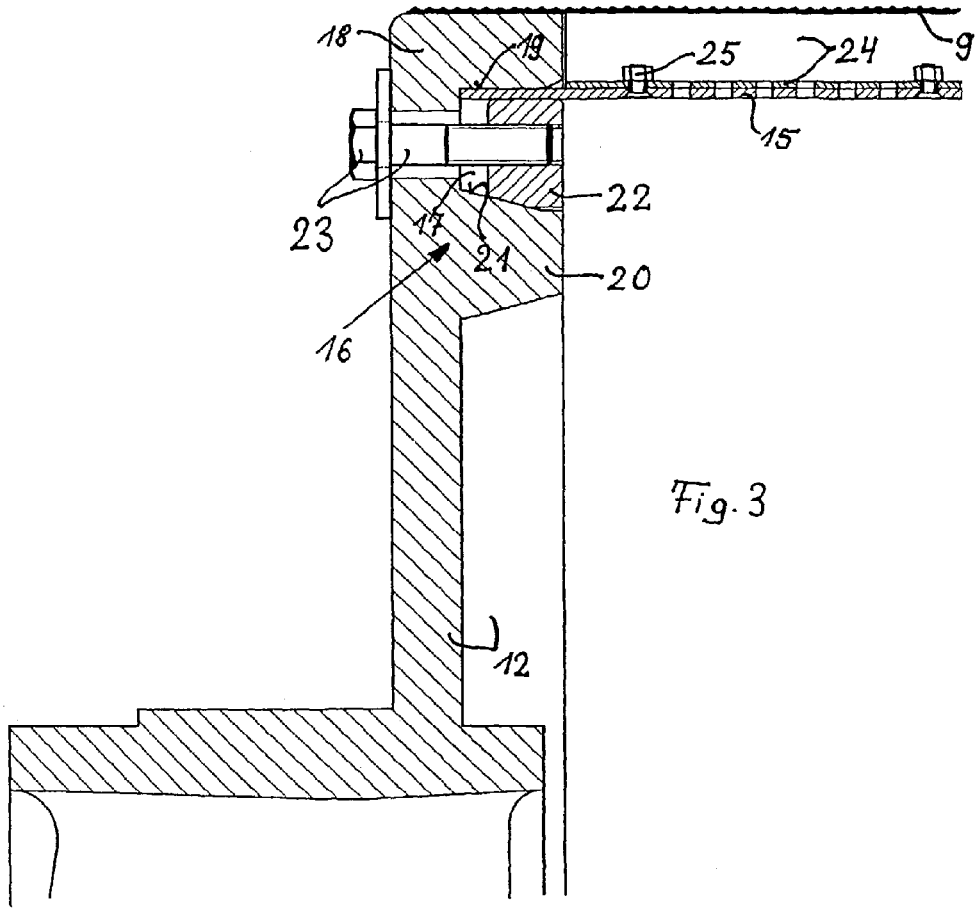
Figure 4:
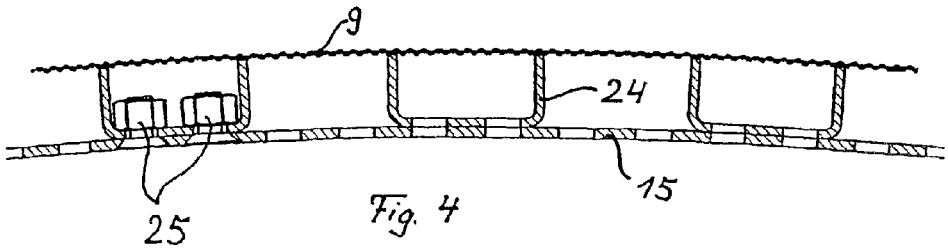

An apparatus of the type according to the invention is represented as an example in the drawing. Further design details are to be described by way of this latter. In which:

FIG. 1 is a section longitudinally through a conventional sieve drum apparatus, the metal jacket of which consists of a perforated sieve drum-jacket with U-profiles screwed thereon and a sieve woven fabric placed externally, FIG. 2 is an enlarged representation of the left-hand base portion in FIG. 1, FIG. 3 is another enlarged representation showing detail ill in FIG. 2, that-is-to-say the clamping fastening of the sieve drum plate to the base portion and FIG. 4 is a section along the line IV—IV in FIG. 3.

A sieve drum apparatus comprises in principle a housing 1, which is approximately square and is divided by an intermediate wall 2 into a treatment chamber 3 and a blower chamber 4. The sieve drum 5 is mounted so as to be rotatable in the treatment chamber 3 and concentrically relative to this a blower 6 is mounted so as to be rotatable in the blower chamber 4 behind the nozzle star 13. Obviously the blower can also be disposed in a special blower housing, which is separated from the sieve drum housing 1 and is not illustrated here. In any case, the blower subjects the interior of the drum 5 to induced draught. The drum design on a wet treatment apparatus, which can also only be for sucking off fluid, is also an object of the patent. The overall design must then be adapted accordingly.

In accordance with FIG. 1, heating units 7, which are made up by tubes which are flowed through by heating medium, are disposed respectively above and below the blower 6. The heated air is blown into the pressure chamber above and below the sieve drum, which is defined in the direction of the sieve drum by the pressure ceiling 10. This provides a uniform air distribution over the operating width. The sieve drum is protected internally against the induced draught, in the region not covered by the textile material, by an inner covering 9, which is supported on the axle 14. The jacket structure of the sieve drum, carrying the textile material, is formed by the drum with U-shaped spacers described below. This latter is wrapped around externally by a fine-mesh sieve 9, which is retained in a tensioned manner at the end faces of the drum on the base portion 12 and on the base portion 11.

FIG. 2 simply shows an enlargement of the drum base portion 12 with partially another more sturdy basic design. The metal drum-jacket 15 is formed from a perforated sieve plate. The detail III, which is shown in FIG. 2 can be better recognised in FIG. 3.

The sieve drum plate 15, which runs in the circumferential direction and extends in total in a straight line, is retained in a non-curved manner in the clamping structure. To this end, an annular groove 17 is milled in the radially outer end ring 16 from the drum side, in which groove 17 the edge of the metal drum-jacket is clamped in a secured manner. Radially outwardly in the side wall 18, the annular groove 17 has a contact surface 21, which is aligned so as to be conical in the direction of the metal drum-jacket 15, shown horizontal in FIG. 3. The radial inner side wall 20, contrary to this, has a contact surface 21, which is aligned so as to be conical in the direction of the drum axis. Whilst the edge of the drum jacket surface is inserted into the annular groove 17 and abuts the side wall 18, a circular clamping member 22, which is adapted in size and is correspondingly provided with a straight and inclined clamping surface, is moved into the remaining space between drum plate 15 and clamping surface 21 and is pulled into the space by clamping bolts 23, which are inserted from the outside of the base portion 12, and the drum plate is thereby securedly clamped in the base portion 12. The clamping member 22 should be a part of a clamping ring, which is adapted to the diameter of the clamping groove 17, which clamping ring is cut into a few segments for the assembly of the drum jacket.

Profiles 24, which are bent in a U-shaped manner and carry the sieve fabric 9 surrounding the drum externally, are screwed onto the outside of the metal drum-jacket 15. Two screws 25 are provided at the same height for securing the U profiles to the sieve drum jacket 24, however, one would also be enough here and the two can also be disposed offset one to the other. The U profiles 24 have a perforation which is adapted to the sieve drum 15. The perforations in the profiles, therefore, coincide with those in the drum such that a uniform air distribution is guaranteed over the entire surface of the drum. For the sturdy securing of the metal drum-jacket 15 in the clamping groove 17, the base portion 12 must have a side wall 18 radially outwardly and this side wail must be of a certain height. The U profiles 24 are configured exactly above this radial location such that the sieve woven fabric 9 can be secured to this side wall 18 without any kinks.

The invention claimed is:

1. Apparatus for treating, where applicable, strip-form textile material, non-woven fabric, woven fabric or paper in a continuous stream using a gaseous agent, which is circulated in the apparatus, having a permeable drum as the conveying member, which drum has base portions on its end face and is subject to an induced draught, wherein a metal drum-jacket, which is securedly connected to the base portions, extends between the base portions of the drum, characterised in that the metal drum-jacket is connected substantially over its entire circumference to the associated base portion in a uniformly secured but detachable manner by a circular clamping connection, the circular clamping connection comprising, on the side facing the centre of the drum, an annular groove formed in the base portion at the radial location of the metal drum-jacket, which is to be secured there, in which annular groove the metal drum-jacket is securedly clamped around the drum, the annular groove forming two clamping jaws, at least one of the clamping jaws being tapered in the direction of the centre of the drum, and a ring-shaped clamping member for clamping the metal drum-jacket between the ring-shaped clamping member and one of the clamping jaws, wherein a conically aligned side wall of the ring-shaped clamping member is adapted to the inclination of the at least one tapered clamping jaw of the clamping groove.

2. Apparatus according to claim 1, characterised in that the annular groove has only one tapering clamping jaw, this being the radially internal clamping jaw where the metal drum-jacket is disposed radially outwardly.

3. Apparatus according to claim 2, characterised in that the clamping jaw is aligned axially in the direction of the metal drum-jacket for the non-curved installation of the edge strip of the metal drum-jacket.

4. Apparatus according to claim 1, characterised in that the ring-shaped clamping member in its radial dimension corresponds to the location of the clamping groove less the thickness of the material of the metal drum-jacket.

5. Apparatus according to claim 1, characterised in that the ring-shaped clamping member is retained on the associated base portion from externally by means of a plurality of screws.

6. Apparatus according to claim 1, characterised in that respective axially aligned edge portions of the metal drum-jacket are retained over their entire surface between the clamping jaw of the clamping groove and the side wall of the clamping member.

7. Apparatus according to claim 1, characterised in that the ring-shaped clamping member consists of individual circular segments.

8. Apparatus according to claim 1, characterised in that the ring-shaped clamping member is produced from a complete circular ring, which is simply divided repeatedly over the circumference for assembly.

9. Apparatus according to claim 1, characterised in that a ring-shaped clamping groove is defined in the respective base portion by a radially internal side wall and an outer side wall and air distributing members are disposed at the radial location of an outer side wall on the metal drum-jacket.

10. Apparatus according to claim 9, characterised in that U-shaped profiles are mounted spaced from one another on the metal drum-jacket, the webs of which are covered by a sieve-shaped covering radially externally for the receiving of the strip-form goods.

11. Apparatus according to claim 1, further comprising a sieve spaced from and supported radially externally around the metal drum-jacket.

12. Apparatus according to claim 11, wherein the sieve is supported radially externally around the metal drum-jacket by U-shaped profiles mounted spaced from one another on the metal drum-jacket.

* * * * *